US006784907B2

(12) United States Patent
Terao et al.

(10) Patent No.: US 6,784,907 B2
(45) Date of Patent: Aug. 31, 2004

(54) WIRE DOT PRINTER HEAD AND WIRE DOT PRINTER

(75) Inventors: Yasunobu Terao, Shizuoka (JP); Tetsuro Ichitani, Mishima (JP); Masayuki Iinuma, Shizuoka (JP); Takahiro Kawaguchi, Mishima (JP); Keishi Tsuchiya, Shizuoka (JP); Takeshi Okui, Mishima (JP)

(73) Assignee: Toshiba TEC Kabushiki Kaisha, Tokyo (JP)

( * ) Notice: Subject to any disclaimer, the term of this patent is extended or adjusted under 35 U.S.C. 154(b) by 47 days.

(21) Appl. No.: 10/200,180

(22) Filed: Jul. 23, 2002

(65) Prior Publication Data

US 2003/0026636 A1 Feb. 6, 2003

(30) Foreign Application Priority Data

Jul. 23, 2001 (JP) ..... 2001-221164

(51) Int. Cl.[7] ..... B41J 2/32
(52) U.S. Cl. ..... 347/171
(58) Field of Search ..... 347/171, 197; 400/124.01, 124.12, 124.24

(56) References Cited

U.S. PATENT DOCUMENTS

| | | | | | |
|---|---|---|---|---|---|
| 4,389,128 | A | * | 6/1983 | Asano et al. | 400/124.12 |
| 5,184,152 | A | * | 2/1993 | French | 347/197 |
| 5,433,538 | A | * | 7/1995 | Itoh et al. | 400/124.24 |
| 2003/0016982 | A1 | * | 1/2003 | Horii et al. | 400/124.01 |

FOREIGN PATENT DOCUMENTS

| | | |
|---|---|---|
| JP | 9-1890 | 1/1997 |
| JP | 2001-30523 | 2/2001 |

* cited by examiner

*Primary Examiner*—K. Feggins
(74) *Attorney, Agent, or Firm*—Oblon, Spivak, McClelland, Maier & Neustadt, P.C.

(57) ABSTRACT

The present invention is a wire dot printer head wherein a spacer is inserted between a yoke block and a head holder. The yoke block has yokes opposed to plural armatures, coils wound respectively round plural cores whose one ends are opposed to the armatures, and fulcrum portions which hold the armatures so that the armatures can rise and fall with respect to end faces of the cores. The spacer is adapted to move under the action of an external force, thereby changing the spacing between the yoke block and the head holder.

4 Claims, 5 Drawing Sheets

WIRE DOT PRINTER HEAD AND WIRE DOT PRINTER

CROSS REFERENCE TO RELATED APPLICATION

The present application is based on Japanese Priority Document 2001-221164 filed on Jul. 23, 2001.

BACKGROUND OF THE INVENTION

1. Field of the Invention

The present invention relates to a wire dot printer head and a wire dot printer provided with the wire dot printer head.

2. Discussion of the Background

In a wire dot printer head, plural cores with coils wound thereon are arranged radially, annular yokes are disposed inside or outside the cores, plural armatures which actuate wires are arranged so that they can rise and fall with respect to the cores, and the armatures are caused to rise and fall by energizing the coils, thereby causing wires to move at high speed toward a platen to effect printing.

In such a wire dot printer head, in order to effect printing at high speed and improve the print density, it is necessary that the spacing between a front end of the wire dot printer head (wire tips) and the platen, i.e., printing gap, and the stroke of each armature (a displacement quantity in the platen direction of wire) be adjusted depending on paper to be printed while being mutually taken into account.

For example, in case of using an ink ribbon, the printing gap in the wire dot printer head is set at a value which is obtained by adding a minimum gap necessary for smooth paper feed to the sum of paper thickness and ink ribbon thickness. When printing is performed for one sheet of paper, there accrues an advantage if the armature stroke is set to a minimum to increase the printing speed. When printing is performed for paper with carbon applied to the back side thereof or for a slip comprising plural superimposed sheets of a pressure-sensitive paper, it is necessary to make the armature stroke large even if the printing speed decreases, or else the pressing force of wire against the slip will become insufficient and the lower the paper position, that is, the closer to the platen, the smaller will be the pressing force of wire and lower the print density, so it is necessary to make the armature stroke large.

As to the method for adjusting such printing gap and armature stroke, it is described, for example, in Japanese Published Unexamined Patent Application No. Hei 9-1890. According to this method, both adjustment of the printing gap and adjustment of the armature stroke are performed simultaneously.

In the above method, however, a constituent member for adjusting the printing gap and a constituent member for adjusting the armature stroke are provided separately in the wire dot printer head and are interlocked with each other through an interlocking member. Consequently, the device configuration of the wire dot printer head is complicated and the manufacturing cost becomes high.

SUMMARY OF THE INVENTION

Accordingly, an object of the present invention is to provide a wire dot printer head and a wire dot printer both able to simplify the construction for the adjustment of armature stroke and printing gap and attain the reduction of cost.

The object of the present invention is achieved by the novel wire dot printer head and wire dot printer of the present invention.

In the wire dot printer head of the present invention, a spacer is inserted between a yoke block and a head holder. The yoke block comprises yokes opposed to plural armatures, coils wound respectively round plural cores which are opposed at one ends thereof to the armatures, and fulcrum portions which hold the armatures so that the armatures can rise and fall with respect to end faces of the cores. The spacer is adapted to move upon exertion of an external force thereon, thereby changing the spacing between the yoke block and the head holder. Thus, since the distance between the head holder and the platen changes, it is possible to adjust the printing gap. At the same time, since the armature-core gap changes, it is possible to adjust the armature stroke and hence possible to simplify the construction for the adjustment of armature stroke and printing gap and attain the reduction of cost.

BRIEF DESCRIPTION OF THE DRAWINGS

A more complete appreciation of the present invention and many of the attendant advantages thereof will be readily obtained as the same becomes better understood by reference to the following detailed description when considered in connection with the accompanying drawings, wherein.

DETAILED DESCRIPTION OF THE PREFERRED EMBODIMENTS

Figure 1:
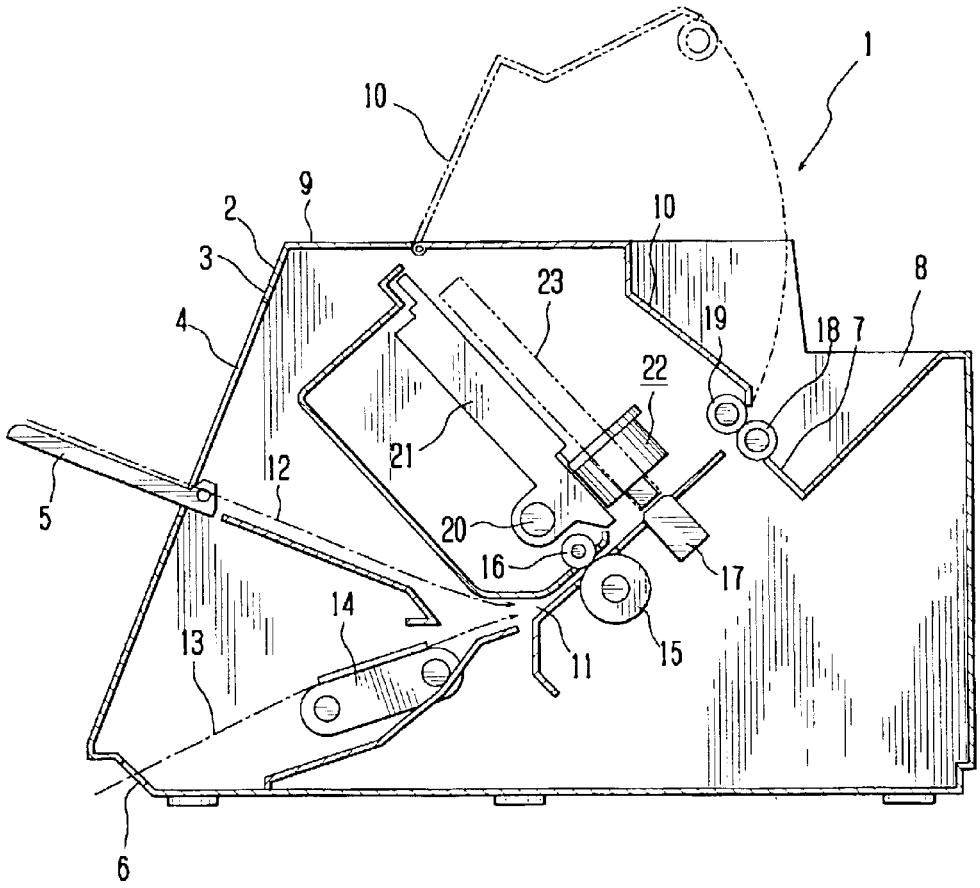
FIG. 1 is a side view in vertical section showing schematically a wire dot printer according to a first embodiment of the present invention.

A first embodiment of the present invention will be described with reference to FIGS. 1 to 3. FIG. 1 is a side view in vertical section showing a wire dot printer of this embodiment schematically. As shown in FIG. 1, the wire dot printer, indicated at 1, is provided with a body case 2. An opening 4 is formed in a front side 3 of the body case 2. A manual feed tray 5 is provided in the opening 4 so that it can be opened and closed. A paper feed port 6 is formed in a lower portion of the body case 2 located near the front side 3. On a rear side 7 of the body case 2 is provided a discharged paper receptacle 8. Further, an opening/closing cover 10 is provided pivotably on an upper surface 9 of the body case 2. The opening/closing cover 10 in an opened state is as indicated in phantom in FIG. 1.

A paper conveying path 11 is provided within the body case 2. An upstream side in the paper conveying direction of the paper conveying path 11 is connected to both a paper feed passage 12 disposed on an extension plane of the manual feed tray 5 in an opened state and a paper feed passage 13 communicating with the paper feed port 6, while a downstream side in the paper conveying direction of the paper conveying path is connected to the discharged paper receptacle 8.

A tractor 14 serving as a paper conveying device is disposed along the paper feed passage 13. A conveying roller 15 and a pressing roller 16 are disposed in opposition to each other in the paper conveying path 11, the pressing roller 16 being in pressure contact with the conveying roller 15. The conveying roller 15 and the pressing roller 16 constitute a paper conveying device. Further, a platen 17 is disposed in the paper conveying path 11 and a paper discharge roller 18 is disposed in an inlet of the discharged paper receptacle 8. A pressing roller 19 is put in pressure contact with the paper discharge roller 18 and is supported rotatably on a free end side of the opening/closing cover 10.

A carrier 21 is slidably fitted on a carrier shaft 20 which is installed in the body case 2 in parallel in a shaft direction with a shaft of the conveying roller 15. The carrier 21 is adapted to reciprocate along the platen 17. On the carrier 21 is held a wire dot printer head 22, and an ink ribbon cassette 23 is supported on the carrier removably. A printing direction in this wire dot printer head is in opposition to the platen 17. The carrier 21 is reciprocated by a known conveyance mechanism which converts a rotational motion of a carrier motor (not shown) to a linear motion with use of a belt or wire and transmits the linear motion to the carrier 21.

The wire dot printer head 22 will now be described in detail. FIG. 2 is a side view in vertical section showing the wire dot printer head 22 and FIG. 3 is a perspective view showing a spacer. As shown in FIG. 2, a container-like housing 24 having one open end is provided in the wire dot printer head 22. The housing is provided with a mounting portion 24*a*, which is positioned and fixed to the carrier 21. On the other end of the mounting portion 24*a* in the housing 24 there is provided a head holder 25.

In the wire dot printer head 22 is provided a wire guide 26 projecting from the interior of the housing 24. An armature guide 27, which is opposed to the bottom of the housing 24, is formed integrally with the wire guide 26 at one end of the wire guide 26. The armature guide 27 is formed with plural guide pins 28 and projecting pieces (not shown) for guiding both sides of each armature 29. An armature spring 30 and a fulcrum pressing spring 31 which is weaker in pressing force than the armature spring 30 are disposed inside and outside, respectively, of each guide pin 28 and are held by the armature guide 27. The armatures 29 are fitted on the guide pins 28 of the armature guide 27. Plural wires 32 are fixed at base end portions thereof to tip end portions of the armatures 29 and are held slidably by plural guide chips 33 which are fixed to the wire guide 26. Front ends of the wires 32 are arranged rectilinearly and are held slidably by means of a tip guide 25*a* formed in the head holder 25. Further, plural cutout portions (not shown) are formed in the armature guide 27 and plural blocks 24*b*, which are integral with the housing 24, are slidably fitted in the cutout portions. The head holder 25 and an armature stopper 34 are coupled together with screws 35, whereby the head holder 35, wire guide 26 and armature stopper 34 are assembled together.

In the wire dot printer head 22, plural cores 37 with coils 36 mounted thereon respectively are formed integrally with yokes 38, and a substrate 39 with the coils 36 connected thereto is fixed to rear sides of the yokes 38. These are formed by a yoke block 40. Connectors 41, which are connected to the substrate 39, are partially projected from openings 43 formed in a holder 42 which is disposed on a rear side of the substrate 39, for connection to external circuits (not shown) in the wire dot printer head 22.

Plural spacers 44 are radially arranged and inserted between the head holder 25 and the yoke block 40. As shown in FIG. 3, each spacer 44 has a thin plate portion 45 on a tip end side thereof and is provided on a base end side thereof with a thick plate portion 46 and a knob 47, with an elongated hole 48 being formed from the thin plate portion 45 to the thick plate portion 46. A screw 49, which will be describe later, is inserted through the elongated hole 48. Each spacer 44 is inserted between the head holder 25 and the yoke block 40 from its tip, thin plate portion 45 side.

Figure 2:
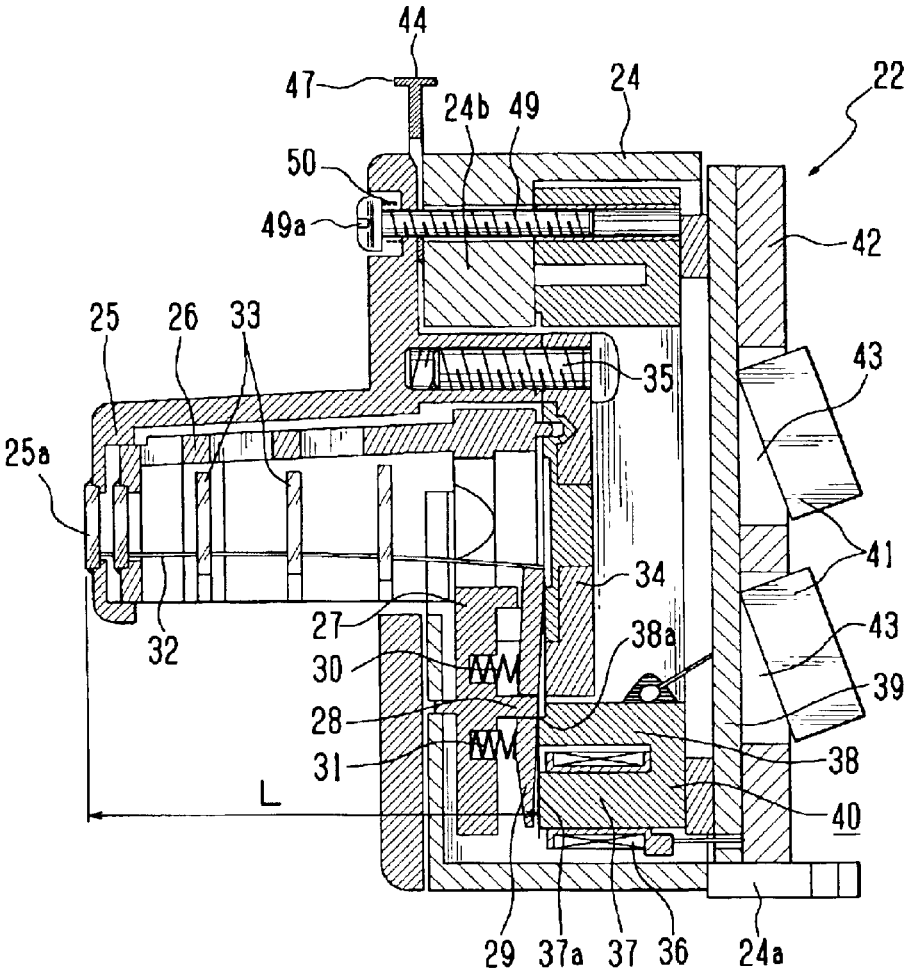
FIG. 2 is a side view in vertical section showing a wire dot printer head.
Figure 3:
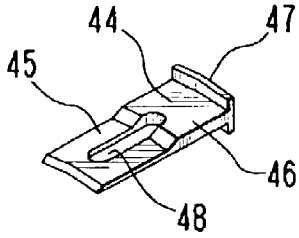
FIG. 3 is a perspective view showing a spacer.

As shown in FIG. 2, the head holder 25 and the yoke block 40, with the spacers 44 held therebetween, are coupled together using plural screws 49 as connecting members. Like the spacers 44, the screws 49 are also arranged radially and are inserted through the head holder 25, then through elongated holes 48 in the spacers 44 and further through the blocks 24*b* of the housing 24, then are threadedly connected to the yokes 38. A spring 50 as a connecting member is interposed between a head 49*a* of each screw 49 and the head holder 25.

In an assembled state of the wire dot printer head 22 described above, inner surfaces of the armatures 29 are in opposition to attracting faces 37*a* of the cores 37 and are supported for rise and fall motions by fulcrum portions 38*a* under the action of pressing force of the fulcrum pressing springs 31. The fulcrum portions 38*a* are annular edges formed on the yokes 38.

In the wire dot printer 1 constructed as above, paper is fed from the manual feed tray 5 in case of using a slip as printing paper, while in case of using a continuous paper, the paper is fed from the paper feed port 6. No matter which type of paper may be used, the paper fed is conveyed by the conveying roller 15 and is discharged to the discharged paper receptacle 8 by the paper discharge roller 18. In the process from the feed to discharge of paper there is made printing by the wire dot printer head 22. Printing is performed in the following manner. By energizing the coils 36 selectively in the wire dot printer head 22, the associated armature 29 is attracted by the attracting face 37*a* of the associated core 37 and pivots about the fulcrum portion 38*a*, so that the tip of the associated wire 32 strikes paper (not shown) on the platen 17 through an ink ribbon (not shown), whereby printing is effected. When the coil 36 is de-energized, the armature 29 returns under the urging force of the armature spring 30. In this case, a return position of the armature is determined by the armature stopper 34.

Next, the following description is provided about adjusting the printing gap in the wire dot printer head 22 and adjusting the stroke of each armature 29. First, when the wire dot printer head 22 is OFF, the armature 29 is brought into abutment against the fulcrum portion 38*a* of the yoke 38 by means of the fulcrum pressing spring 31 and in a portion thereof near its tip end located on the wire 32 side, which is urged by the armature spring 30, a return position is determined by the armature stopper 34. At this time, the stroke of the armature 29 is decided on the basis of the spacing between the armature 29 and the attracting face 37*a* of the core 37. The closer the fulcrum portion 38*a* to the tip end side of the wire 32 with respect to an armature 29-side face of the armature stopper 34, the more inclined a plane relative to an armature 29-side face of the armature stopper 34, the plane connecting an abutment portion between the armature 29 and the armature stopper 34 with the fulcrum portion 38*a*, and the wider the spacing between a rear end-side inner surface of the armature 29 and the attracting face 37*a* of the core 37.

FIG. 2 shows a state in which the thin plate portion 45 of each spacer 44 is inserted between the head holder 25 and the yoke block 40. In this state, the opposed spacing between the head holder 25 and the yoke block 40 is the narrowest, while the opposed spacing between the head holder 25 and the platen 17 becomes large and so does the printing gap. At this time, the fulcrum portion 38*a* is positioned closest to the tip end side of the wire 32 with respect to the armature 29-side face of the armature stopper 34, so that the stroke of the armature 29 becomes large.

On the other hand, if a force as a moving force is applied with, for example, a human finger to the knob 47 of the spacer 44 which projects from the outer periphery of the housing 24, to push the spacer 44 toward the interior of the wire dot printer head 22, the thick plate portion 46 of the spacer 44 is inserted between the head holder 25 and the yoke block 40 and the head holder 25 moves toward the platen 17, so that the opposed spacing between the head holder 25 and the platen 17 becomes small and so does the printing gap. At the same time, the opposed spacing between the head holder 25 and the yoke block 40 becomes maximum and the fulcrum portion 38*a* approaches the armature 29-side face of the armature stopper 34. In this state, the plane connecting the abutment portion between the armature 29 and the armature stopper 34 with the fulcrum portion 38*a* exhibits a tendency to approaching parallel with respect to the armature 29-side face of the armature stopper 34, the spacing between the rear end-side inner surface of the armature 29 and the attracting face 37*a* of the core 37 becomes narrow, and the stroke of the armature 29 becomes small. In this case, the opposed spacing between the armature guide 27 and the housing 24 becomes minimum.

The printing gap and the stroke of the armature 29 can be reduced by picking and pulling the knob 47 of the spacer with fingers to draw out the thick plate portion 46 of the spacer 44 between the head holder 25 and the yoke block 40.

By thus moving the spacer 44 to adjust the spacing between the head holder 25 and the yoke block 40 it is possible to adjust the printing gap and the stroke of the armature 29 simultaneously according to the purpose of use. In this way, in case of printing a single sheet of paper, by setting small the printing gap to match the paper thickness, the stroke of the armature 29 becomes small, so that there is obtained a clear print and it is possible to effect printing at high speed. In case of printing paper which comprises a plurality of superimposed sheets, by setting large the printing gap to match the paper thickness, the stroke of the armature 29 becomes large and the pressing force of each wire 32 reaches the bottom sheet from the top sheet. Thus, even in printing a slip or the like, it is impossible that there will occur a light/shade difference.

Further, since the armature stopper 34 is fixedly connected with screws 35 to the head holder 25 having the tip guide 25*a*, the distance L from the abutment portion between the armature 29 and the armature stopper 34 to the tip of each wire 32 is maintained constant and the stroke of the armature 29 can be adjusted without changing the position of the tip end face of the wire relative to the surface of the tip guide 25*a*.

As described above, according to the wire dot printer 1 and wire dot printer head 22 of this embodiment, by mounting the yoke block 40 to the carrier 21 and by providing the spacers 44, screws 49 and springs 50, the adjustment of the printing gap and the adjustment of the armature stroke can be done at a time. Consequently, it is possible to simplify the mechanism for both adjustments and hence possible to reduce the manufacturing cost.

Although in this embodiment each spacer 44 is moved by applying force to the knob 47 with a finger, the means for moving the spacer 44 is not limited thereto. For example, each spacer 44 may be moved by operation of a drive source such as solenoid.

A second embodiment of the present invention will be described below with reference to FIGS. 4 to 6. The same portions as in the first embodiment are identified by the same reference numerals as in the first embodiment and explanations thereof will here be omitted.

Figure 4:
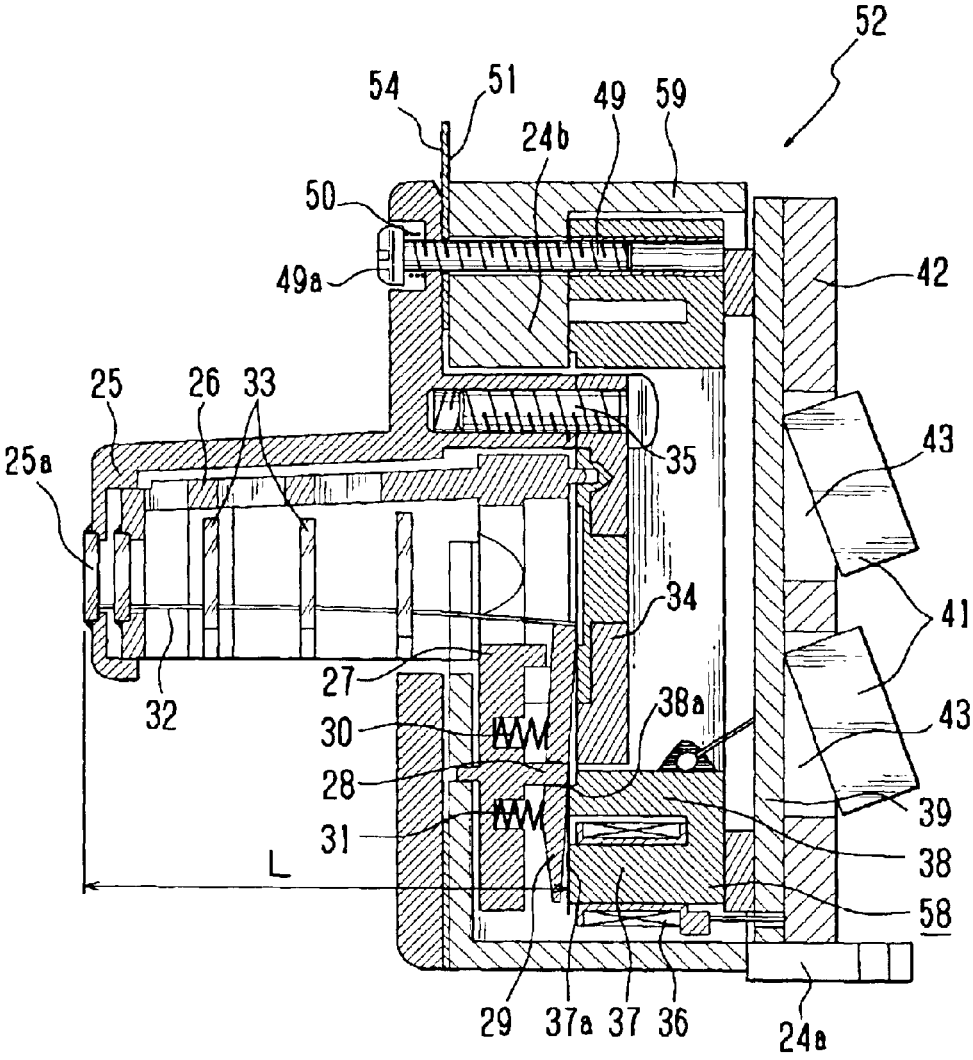
FIG. 4 is a side view in vertical section showing a wire dot printer head according to a second embodiment of the present invention.

FIG. 4 is a sectional view in vertical section showing a wire dot printer head of this second embodiment. This embodiment is the same in basic construction from the first embodiment and is different from the first embodiment in that instead of the spacers 44 used in the wire dot printer head 22 of the first embodiment, an annular spacer 51 is inserted between a head holder 25 and a yoke block 58 in a wire dot printer head 52.

Figure 5A:
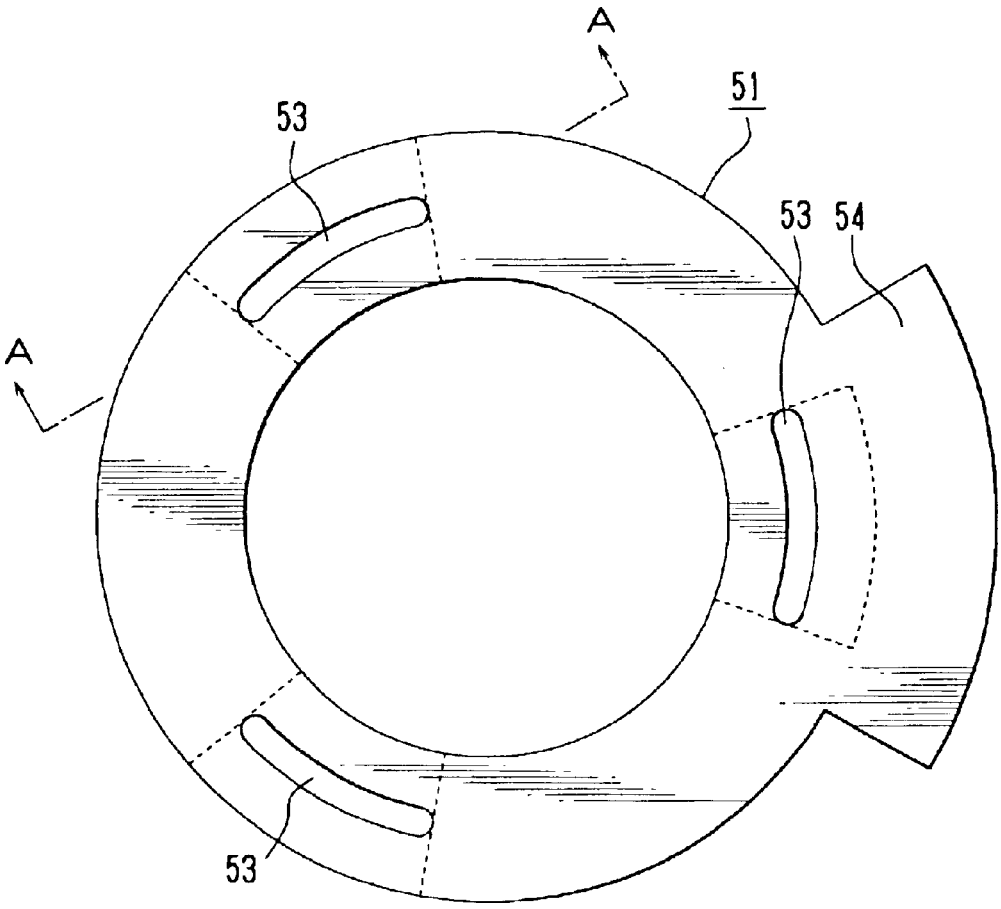
FIG. 5A is a plan view showing a spacer.
Figure 5B:
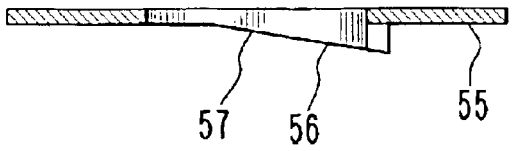
FIG. 5B is a sectional view taken on line A—A in FIG. 5A.
Figure 6A:
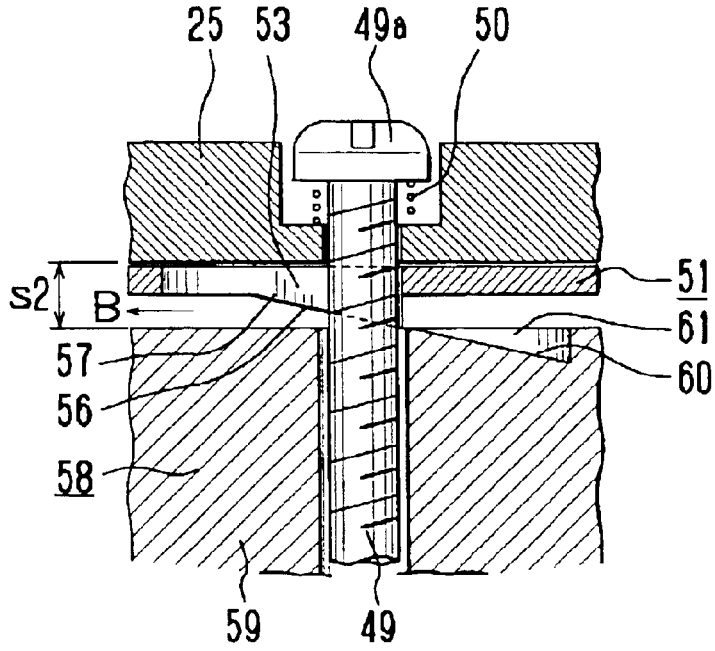
FIG. 6A is a horizontal sectional view showing partially in section in what state the printing gap and the armature stroke are adjusted small.
Figure 6B:
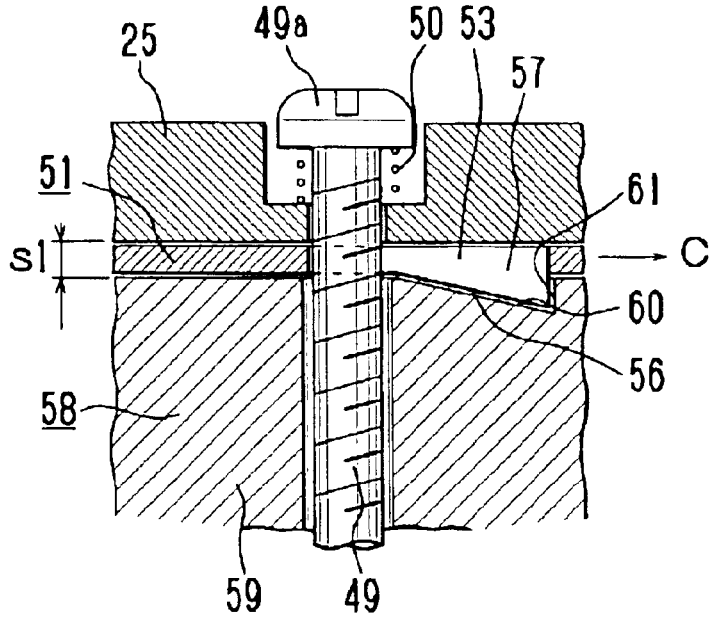
FIG. 6B is a horizontal sectional view showing partially in section in what state the printing gap and the armature stroke are adjusted large.

FIG. 5 illustrates the spacer 51, in which FIG. 5A is a perspective view and FIG. 5B is a sectional view taken on line A—A in FIG. 5A. FIG. 6 is illustrates, partially in section, in what state the printing gap and the armature stroke are adjusted, in which FIG. 6A is a horizontal sectional view showing in what state the printing gap and the armature stroke are adjusted small and FIG. 6B is a horizontal sectional view showing in what state the printing gap and the armature stroke are adjusted large. As shown in FIG. 5A, the spacer 51 is formed with plural elongated arcuate holes 53 through which screws 49 are inserted and is also formed with a lever 54 which projects radially from a part of the outer periphery of the spacer. As shown in FIG. 5B, projecting portions 57 are formed on an inner surface 55 of the spacer 51 which inner surface is located on the yoke block 40 side, the projecting portions 57 each having a slant face 56 whose projecting height from the inner surface 55 changes continuously according to circumferential positions. In correspondence thereto, as shown in FIG. 6, plural recesses 61 for engagement with the projecting portions 57 are formed in an end face of a housing 59 of the yoke block 58, the recesses 61 each having a slant face 60 in the same direction as the slant direction of the slant face 56 of each projecting portion 57.

In such a construction, as shown in FIG. 6A, when the spacer 51 is rotated in the direction of arrow B by applying force as a moving force to the lever 54 of the spacer 51 with fingers for example, causing the projecting portions 57 to get out of the recesses 61, the opposed spacing between the head holder 2 and the yoke block 40 becomes wide as indicated at s2. In this state, as described in the first embodiment, the printing gap and the stroke of each armature 29 become minimum.

In contrast therewith, as shown in FIG. 6B, when the spacer 51 is rotated in the direction of arrow C by applying force to the lever 54 of the spacer 51 with fingers, causing the projecting portion 57 to be engaged in the recesses 61, the opposed spacing between the head holder 25 and the yoke block 40 becomes narrow as indicated at s1. In this state, the printing gap and the stroke of the armature 29 become maximum as described in the first embodiment.

As set forth above, according to the wire dot printer 1 and wire dot printer head 22 of this embodiment, by mounting the yoke block 58 having recesses 61 to the carrier 21 and by providing the spacer 51, screws 49 and springs 50, the printing gap and the armature stroke can be adjusted at a time, so it is possible to simplify the construction for both adjustments and reduce the cost.

Although in this embodiment the spacer 51 is moved by applying force to the lever 54 with fingers, the means for moving the spacer 51 is not limited thereto. For example, the spacer 51 may be moved by operation of a drive source such as a motor.

Obviously, numerous modifications and variations of the present invention are possible in light of the above teachings. It is therefore to be understood that within the scope of the appended claims, the invention may be practiced otherwise than as specifically described herein.

What is claimed is:

1. A wire dot printer head, comprising:

a plurality of armatures;

a yoke block including: yokes opposed to the plural armatures; coils wound respectively round a plurality of cores whose one ends are opposed to the armatures; and fulcrum portions which hold the armatures so that the armatures can rise and fall with respect to end faces of the cores;

a plurality of wires attached to the armatures and actuated in a printing direction by rising and falling motions of the armatures;

a head holder having a tip guide for arranging at least the tips of the wires slidably in regular order;

an armature stopper fixedly mounted to the head holder, supporting vicinities of end portions at the wire side of the armatures as urged in a return direction, and determining return positions of the armatures;

a spacer inserted between the yoke block and the head holder, and adapted to move under the action of an external force, thereby changing the spacing between the yoke block and the head holder; and a connecting member for connecting the yoke block and the head holder with each other with the spacer therebetween, wherein the spacer has a tip end-side thin plate portion and a base end-side thick plate portion, an elongated hole for insertion therethrough of the connecting member is formed in the spacer from the thin plate portion to the thick plate portion, and a plurality of the spacers are inserted radially between the yoke block and the head holder from the tip end sides thereof.

2. A wire dot printer head, comprising:

a plurality of armatures;

a yoke block including: yokes opposed to the plural armatures; coils wound respectively round a plurality of cores whose one ends are opposed to the armatures; and fulcrum portions which hold the armatures so that the armatures can rise and fall with respect to end faces of the cores;

a plurality of wires attached to the armatures and actuated in a printing direction by rising and falling motions of the armatures;

a head holder having a tip guide for arranging at least the tips of the wires slidably in regular order;

an armature stopper fixedly mounted to the head holder, supporting vicinities of end portions at the wire side of the armatures as urged in a return direction, and determining return positions of the armatures;

a spacer inserted between the yoke block and the head holder, and adapted to move under the action of an external force, thereby changing the spacing between the yoke block and the head holder; and a connecting member for connecting the yoke block and the head holder with each other with the spacer therebetween, wherein the spacer has a tip end-side thin plate portion, a base end-side thick plate portion which becomes thicker gradually from the thin plate portion, and a knob, an elongated hole for insertion therethrough of the connecting member is formed in the spacer from the thin plate portion to the thick plate portion, and a plurality of the spacers are inserted radially between the yoke block and the head holder from the tip end sides thereof.

3. A wire dot printer, comprising a wire dot printer head including:

a plurality of armatures;

a yoke block including yokes opposed to the plural armatures; coils wound respectively round a plurality of cores whose one ends are opposed to the armatures; and fulcrum portions which hold the armatures so that the armatures can rise and fall with respect to end faces of the cores;

a plurality of wires attached to the armatures respectively and actuated in a printing direction by rising and falling motions of the armatures;

a head holder having a tip guide for arranging at least the tins of the wires slidably in regular order;

an armature stopper fixedly mounted to the head holder, supporting vicinities of end portions at the wire side of the armatures as urged in a return direction, and determining return positions of the armatures;

a spacer inserted between the yoke block and the head holder, and adapted to move under the action of an external force, thereby changing the spacing between the yoke block and the head holder; and a connecting member for connecting the yoke block and the head holder with each other with the spacer therebetween;

a platen opposed to the wire dot printer head;

a carrier which holds the wire dot printer head and which is reciprocated along the platen; and a paper conveying device for conveying payer between the wire dot printer head and the platen, wherein the spacer has a tip end-side thin plate portion and a base end-side thick plate portion, an elongated hole for insertion therethrough of the connecting member is formed in the spacer from the thin plate portion to the thick plate portion, and a plurality of the spacers are inserted radially between the yoke block and the head holder from the tip end sides thereof.

4. A wire dot printer, comprising a wire dot printer head including:

a plurality of armatures;

a yoke block including: yokes opposed to the plural armatures; coils wound respectively round a plurality of cores whose one ends are opposed to the armatures; and fulcrum portions which hold the armatures so that the armatures can rise and fall with respect to end faces of the cores;

a plurality of wires attached to the armatures respectively and actuated in a printing direction by rising and falling motions of the armatures;

a head holder having a tip guide for arranging at least the tips of the wires slidably in regular order;

an armature stopper fixedly mounted to the head holder, supporting vicinities of end portions at the wire side of the armatures as urged in a return direction, and determining return positions of the armatures;

a spacer inserted between the yoke block and the head holder, and adapted to move under the action of an external force, thereby changing the spacing between the yoke block and the head holder; and a connecting member for connecting the yoke block and the head holder with each other with the spacer therebetween;

a platen opposed to the wire dot printer head;

a carrier which holds the wire dot printer head and which is reciprocated alone the platen; and a paper conveying device for conveying paper between the wire dot printer head and the platen, wherein the spacer has a tip end-side thin plate portion, a base end-side thick plate portion which becomes thicker gradually from the thin plate portion, and a knob, an elongated hole for insertion therethrough of the connecting member is formed in the spacer from the thin plate portion to the thick plate portion, and a plurality of the spacers are inserted radially between the yoke block and the head holder from the tip end sides thereof.

* * * * *